US006876158B2

(12) United States Patent
Tröstl et al.

(10) Patent No.: US 6,876,158 B2
(45) Date of Patent: Apr. 5, 2005

(54) ELECTRONIC BALLAST WITH FULL BRIDGE CIRCUIT

(75) Inventors: Alfred Tröstl, Dornbirn (AT); Alexander Nachbaur, Fraxern (AT)

(73) Assignee: TridonicAtco GmbH & Co. KG, Dornbirn (AT)

( * ) Notice: Subject to any disclaimer, the term of this patent is extended or adjusted under 35 U.S.C. 154(b) by 0 days.

(21) Appl. No.: 10/414,319

(22) Filed: Apr. 16, 2003

(65) Prior Publication Data

US 2004/0004447 A1 Jan. 8, 2004

Related U.S. Application Data

(63) Continuation of application No. PCT/EP01/10497, filed on Sep. 11, 2001.

(30) Foreign Application Priority Data

Oct. 16, 2000 (DE) ..... 100 51 139

(51) Int. Cl.[7] ..... G05F 1/00
(52) U.S. Cl. ..... 315/291
(58) Field of Search ..... 315/219, 243, 315/244, 209 R, 291, 307, DIG. 5, DIG. 7

(56) References Cited

U.S. PATENT DOCUMENTS

| | | | | |
|---|---|---|---|---|
| 4,346,332 A | | 8/1982 | Walden | 315/307 |
| 4,725,762 A | | 2/1988 | Jagschitz | 315/226 |
| 5,187,413 A | | 2/1993 | Araki et al. | 315/291 |
| 5,889,339 A | | 3/1999 | Bildgen | 307/125 |
| 5,914,569 A | | 6/1999 | Bildgen | 315/209 |
| 5,932,976 A | * | 8/1999 | Maheshwari et al. | 315/291 |
| 5,966,106 A | * | 10/1999 | Yamazaki | 345/45 |
| 6,124,682 A | * | 9/2000 | Lakin et al. | 315/291 |
| 6,426,597 B2 | * | 7/2002 | Rast et al. | 315/219 |
| 6,518,712 B2 | * | 2/2003 | Weng | 315/209 R |

FOREIGN PATENT DOCUMENTS

| | | |
|---|---|---|
| AT | 392384 B | 3/1991 |
| DE | 4238388 A | 5/1994 |
| DE | 4416042 A | 1/1995 |
| DE | 4401630 A | 7/1995 |
| DE | 19523750 A | 1/1997 |
| EP | 0473157 A | 3/1992 |
| EP | 0633711 A | 1/1995 |
| EP | 0688152 A | 12/1995 |
| WO | WO 99/04605 A | 1/1999 |

OTHER PUBLICATIONS

Wood, P.N., "High Frequency Discharge Lamp Ballasts Using Power MOSFETS, IGBT'S and High Voltage Monolythic Drivers", PCI Proceedings, Jun. 1989, pp. 307–324, XP000775812.

* cited by examiner

*Primary Examiner*—Don Wong
*Assistant Examiner*—Minh Dieu A
(74) *Attorney, Agent, or Firm*—Fitzpatrick, Cella, Harper & Scinto

(57) ABSTRACT

An electronic ballast for controlling the operating behavior and brightness of a gas discharge lamp, includes a full bridge circuit fed with a d.c. voltage ($U_{BUS}$). The gas discharge lamp is connected as a load of the full bridge circuit, and a control circuit in each case switches on one bridge diagonal and switches off another bridge diagonal of the full bridge circuit, alternatingly. The bridge diagonals each have a regulatable constant current source for regulating a lamp current, and thereby the occurrence of flickering appearances is suppressed. As a result, the lamp can be dimmed over a very wide range of brightnesses.

19 Claims, 4 Drawing Sheets

ELECTRONIC BALLAST WITH FULL BRIDGE CIRCUIT

CROSS REFERENCE TO RELATED APPLICATIONS

This is a Continuation of International Application PCT/EP01/10497 filed Sep. 11, 2001 which in turn claims priority of German Application DE 100 51 139.2 filed Oct. 16, 2000, the priorities of which are hereby claimed, said International Application having been published in German, but not in English, as WO 02/34015 A1 on Apr. 25, 2002. The disclosure of that International Application PCT/EP01/10497 is hereby incorporated by reference in its entirety, as if fully set forth herein.

BACKGROUND OF THE INVENTION

1. Field of the Invention

The present invention relates to an electronic ballast with a full bridge circuit for controlling the operating behavior and brightness of a gas discharge lamp, and to a method for controlling the brightness of a gas discharge lamp.

2. Description of the Related Art

Electronic ballasts with full bridge circuits are preferentially employed for the operation of high pressure gas discharge lamps, but find employment also for low pressure discharge lamps or fluorescent tubes as well. Thereby, the use of a full bridge circuit offers the possibility to operate the lamps with a d.c. current, if applicable with low frequency polarity reversal, through which the arising of disruptive electronic magnetic alternating fields can be reduced. Further, in this case the influence of the lamp wiring on operation, arising as a result of the high frequency conductor impedances, is negligible. Ballasts with full bridge circuits are described for example in DE 44 01 630 A1 or AT 392 384 B.

The basic principle of a full bridge circuit is illustrated in FIG. 6 and will be briefly explained below. The full bridge circuit is constituted by means of four controllable switches S1 to S4, which in the present example are field effect transistors, the two first switches S1 and S2 forming a first half-bridge and the two switches S3 and S4 forming a second half-bridge. As the load of the full bridge circuit there is arranged in its diagonal branch a series resonance circuit consisting of an inductance L and a capacitor C, i.e. the series circuit of the inductance L and the capacitor C connects the common node point between the two switches S1 and S2 of the first half-bridge with the common node point between the two switches S3 and S4 of the second half-bridge. Gas discharge lamp LA is arranged parallel to the capacitor C. The input of the full bridge circuit is fed with a d.c. voltage $U_{BUS}$, the output of the full bridge circuit is connected via a resistance R with ground.

The controlling of the four switches S1 to S4 is effected by means of two driver circuits T1 and T2 to which in turn corresponding control commands for the control of the switches S1 to S4 are passed from a regulation circuit 6. The control of the four switches S1 to S4 is effected as a rule in the following manner.

Initially, in a,first phase, the switches S1 and S4 forming a first bridge diagonal are activated, while the two switches S3 and S2 forming the second bridge diagonal are opened. In this first phase, a current flow takes place from the input of the full bridge circuit via the first switch, the load circuit consisting of the series resonance circuit and the gas discharge lamp LA, and the switch S4. Thereby, one of the two switches, for example the switch S1 is permanently closed, while the switch S4 is clocked at high frequency. With the switching frequency of the switch S4 remaining the same, the power delivered to the lamp LA is increased or reduced through alteration of the duty ratio. In a second phase, the switches S1 and S4 of the first bridge diagonal are then opened whereas now in analogous manner the switches S3 and S2 of the second bridge diagonal are activated, i.e. the switch S3 is permanently closed, whereas the switch S2 is clocked at high frequency with a duty ratio corresponding to the desired power. The change-over between the two bridge diagonals has the consequence that the direction of the current through lamp LA is permanently changed, through which mercury deposits on an electrode are avoided and the lifetime of the lamp is increased. The control of the full bridge circuit is assumed by means of the control circuit 6 to which on the one hand a desired value $I_{SOLL}$ corresponding to the desired lamp brightness is fed and on the other hand the voltage dropped via the shunt resistance R is fed via the input line 7 as actual value. In correspondence with the result of comparison between actual value and desired value, the control circuit 6 generates control commands which are delivered via the lines $\mathbf{8}_1$ to $\mathbf{8}_4$ to the two driver circuits T1 and T2, which in turn translate the control commands into corresponding signals for the control of the gates of the four field effect transistors S1 to S4.

The clocked switch of the bridge diagonal active in each case is opened and closed with a frequency of ca. 20 to 50 kHz. Due to this high frequency clocking, parasitic currents flow via the lamp line capacitances, which make an exact regulation of the lamp brightness, in particular at very low dimming values, impossible, with the consequence that at very low dimming values an undesired flickering of the lamp brightness, perceptible for the eye, appears.

SUMMARY OF THE INVENTION

It is thus the object of the present invention to indicate an electronic ballast with-a full bridge circuit which makes possible a dimming of the gas discharge lamp over a very wide range. In particular, flickering appearances are to be avoided at very low dimming values.

This object is achieved by means of an electronic ballast which has a construction according to this invention, and by means of a method for the control of the brightness of a gas discharge lamp in accordance with this invention. The electronic ballast in accordance with the invention has a full bridge circuit fed with a d.c. voltage, the gas discharge lamp being connected as a load of this full bridge circuit. A control circuit alternately switches in each case one bridge diagonal of the full bridge circuit on, and the other bridge diagonal off. In accordance with the invention, it is proposed that the two bridge diagonals each have a regulatable constant current source for the regulation of the lamp current. In this case, during the switch-on time of one bridge diagonal, a high frequency clocking of a switch can be omitted. Instead, the lamp is operated during the switch-on time of one bridge diagonal with a regulated d.c. current, through which the problem of the parasitic currents due to the high frequency switching processes is avoided. Through this it is attained that also at very low brightness values regulation can be effected very exactly to a constant lamp current and thus a flickering of the lamp can be suppressed. The low frequency switching over between the two bridge diagonals is retained and is effected preferably with a frequency of more than 100 Hz, that is a frequency above the limit of perception of the human eye, in particular with a frequency between 700 Hz and 2000 Hz. Beyond this there exists the possibility, with a lamp operation at very low brightness, to omit the switching over between the two bridge diagonals, since the mercury migration caused by the small lamp current is minimal and is compensated due to the natural diffusion taking place in the lamp plasma.

In order to avoid power losses to the widest extent possible it is to be striven for that the voltage drop via the regulatable constant current sources, which will also be designated as transistor precision current sources, is as small as possible. In accordance with a first preferred exemplary embodiment, the ballast in accordance with the invention thus has a controllable smoothing circuit for the generation of a variable d.c. voltage which is delivered to the full bridge circuit. Beyond this there is provided a regulation circuit which detects the voltage drop at the regulatable constant current source of the bridge diagonal active in each case and so controls the smoothing circuit that this detected voltage corresponds in substance to a predetermined desired value. In this case, the smoothing circuit may be of two switching regulators connected in series, whereby the first switching regulator is preferably an up-converter and the second switching regulator is preferably a down-converter. Thereby, the regulator circuit controls only the down-converter in the desired manner. Alternatively to this, the smoothing circuit can also be formed by means of a buck-boost converter controlled by the regulator circuit.

According to a second preferred exemplary embodiment of the electronic ballast of the invention, the gas discharge lamp is a component of a resonance circuit connected as a load of the full bridge circuit. In a first operational mode, which finds employment at low lamp brightness, the regulation of the lamp current is effected as described above by means of the two regulatable constant current sources of the bridge diagonals, whereby the inductance in this case is not effective due to the d.c. current, rather only its ohmic d.c. resistance. In a second operational mode, however, at high lamp brightness, the control of the power delivered to the lamp is effected by means of alteration of the duty ratio at constant high frequency. That means that in the second operational mode, the regulation of the lamp current by means of the regulatable constant current sources is suppressed and there is effected again a pure clocking of the switches. In this case it is not necessary that a regulation of the d.c. voltage delivered by the smoothing surface of the full bridge circuit is effected, since the regulatable d.c. voltage is put to use only at the lesser lamp brightnesses, here however due to the lesser current intensities the losses play a subordinate role.

In accordance with the first method according to the invention for the control of the brightness, during the switch-on time of a bridge diagonal the gas discharge lamp is operated basically with a regulated d.c. voltage. In accordance with another aspect of the invention, the two modes of operation are put to use, whereby the gas discharge lamp is operated in the first operational mode at low lamp brightness with a regulated d.c. voltage and in second operational mode at high lamp brightness with a d.c. current corresponding to the duty ratio, with superposed ripple current.

BRIEF DESCRIPTION OF THE DRAWINGS

The invention is described in more detail with reference to the accompanying drawings.

DETAILED DESCRIPTION OF THE PREFERRED EMBODIMENT

Figure 1:
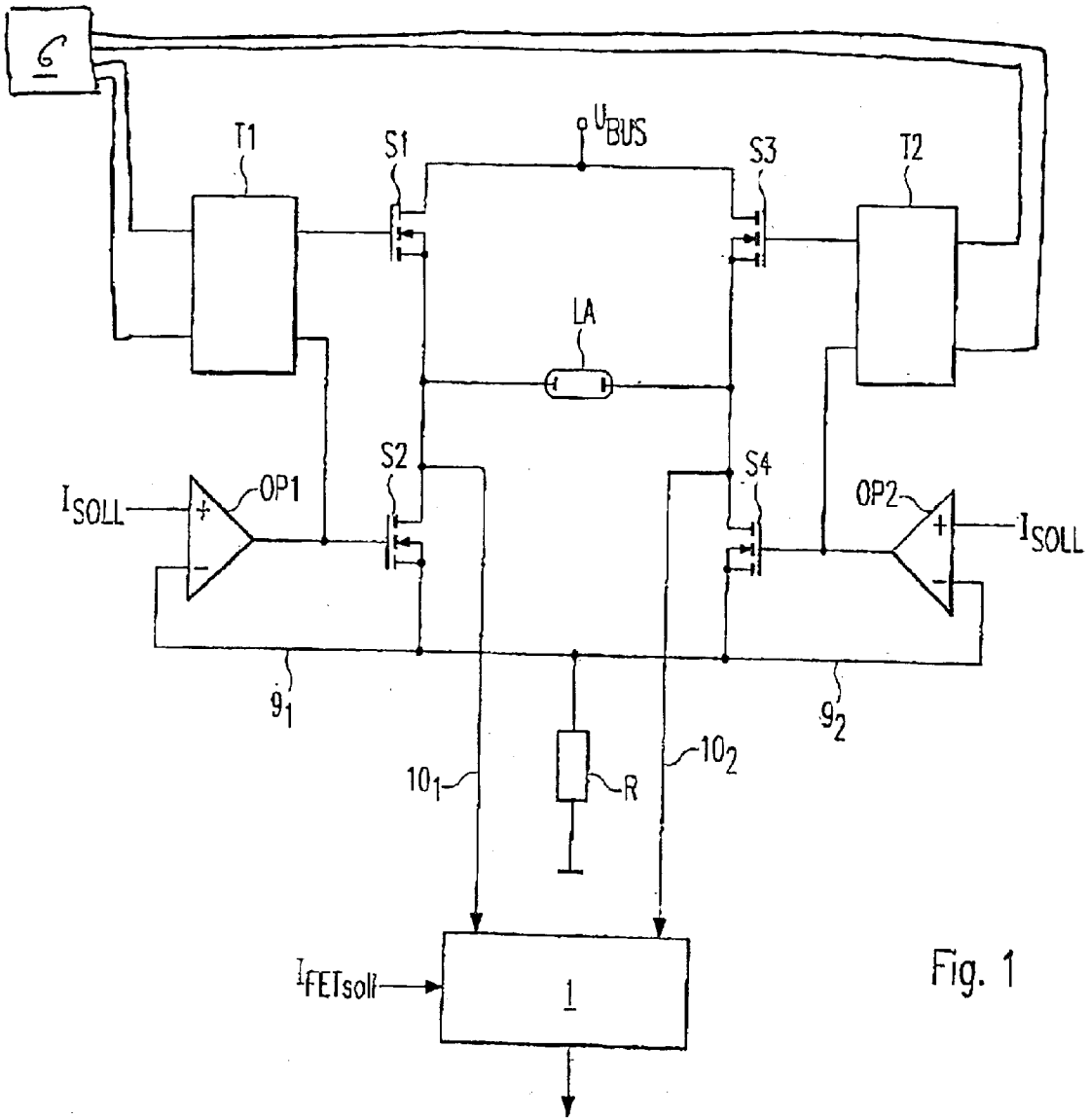
FIG. 1 depicts a first exemplary embodiment of a full bridge circuit in accordance with the invention.
Figure 6:
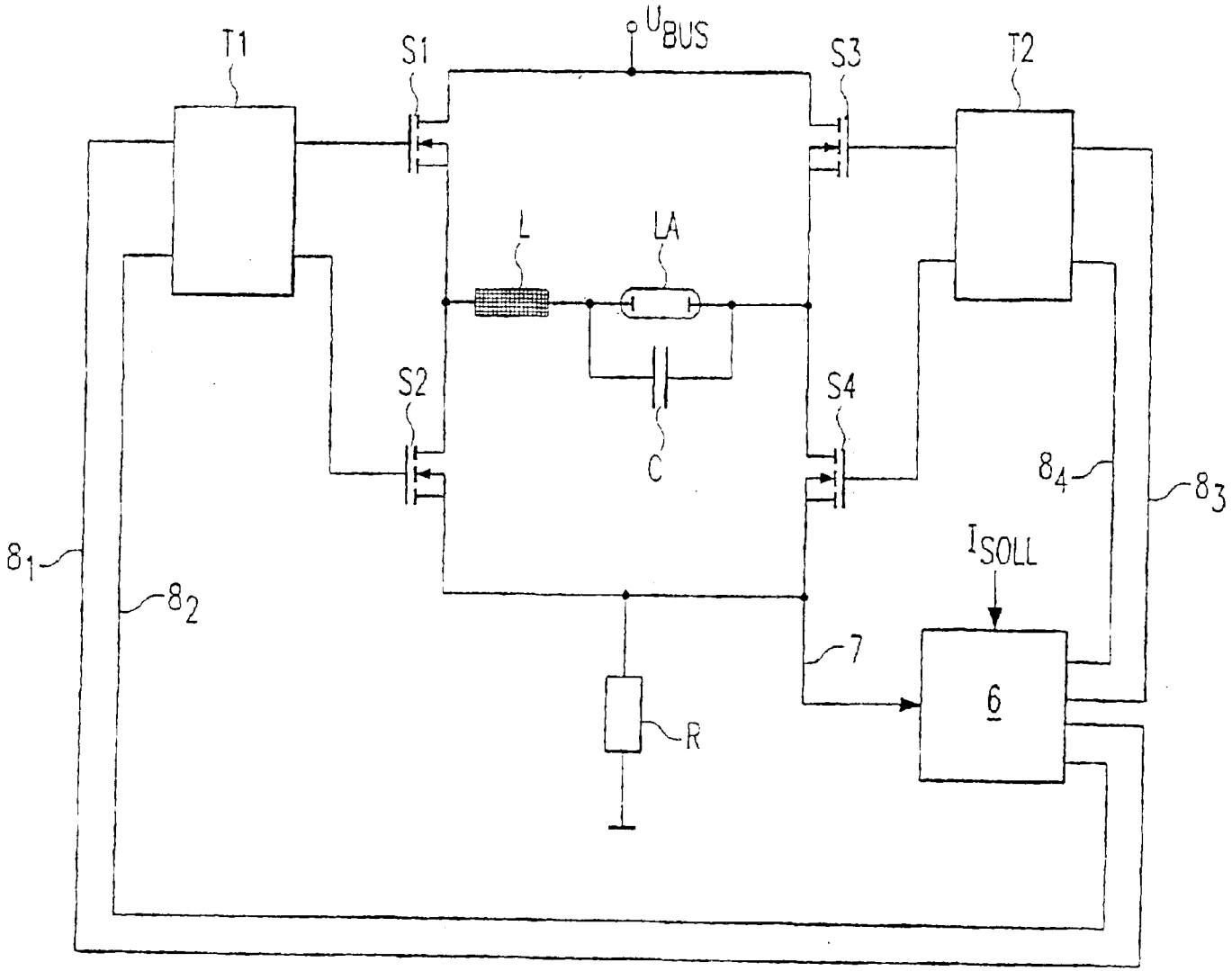
FIG. 6 shows a known full bridge circuit.

The arrangement of the four field effect transistors S1 to S4 of the full bridge illustrated in FIG. 1 is identical to the known arrangement of FIG. 6. Again, a d.c. voltage $U_{BUS}$ is applied to the input of the full bridge circuit, the output of the full bridge circuit being formed by a shunt resistance R connected with ground. Now, however, only the gas discharge lamp LA is connected as a load, the elements of a resonance circuit are no longer present with this first exemplary embodiment. A switching over between the two bridge diagonals is again effected by means of the two driver circuits T1 and T2 which control the four field effect transistors S1 to S4 in a suitable manner. Now however the regulation of the lamp brightness is no longer effected by means of a corresponding switching on and switching off of the switches S1 to S4 by the driver circuits T1 and T2 but through control of the field effect transistors S2 and S4 arranged in the bridge diagonals as regulatable constant current sources. For this purpose these two field effect transistors S2, S4 are operated in each case by an operational amplifier OP1 at OP2 in their dynamic range. Therewith they form a resistance which is connected in series with the lamp LA and in this manner define an operating point for the lamp LA.

The regulatable constant current sources, or the two transistor precision current sources, are thus formed by means of the two lower field effect transistor S2 and S4 of the two half-bridges and two operational amplifiers OP1 and OP2 each controlling the corresponding field effect transistor S2 or S4. Via a feedback line $\mathbf{9}_1$ or $\mathbf{9}_2$, the current flowing through the respective field effect transistor S2 or S4 is delivered to the operational amplifier OP1 OP2 as an actual value, the second input signal is formed by a desired value $I_{SOLL}$ corresponding to the desired lamp brightness which can for example be delivered to the two operational amplifiers OP1 OP2 by means of a dimming circuit or the like. The two operational amplifiers OP1 and OP2 are effective as regulators, which set the current flowing through the two field effect transistors S2 and S4 to a value corresponding to the desired value $I_{SOLL}$.

The control commands necessary for the switching over between the two bridge diagonals are delivered to the two driver circuits T1 and T2 in conventional manner by means of a control circuit 6. Here also there is effected a low frequency change-over between the two bridge diagonals, in order to reduce mercury migration in the lamp LA which arises in the case of a one-sided d.c. current operation.

Since the regulation of the lamp current and therewith of the lamp brightness is effected by means of the two regulatable constant current sources, the use of a current limiting inductance can be omitted. In order, however, to hold the losses at the two field effect transistors S2 and S4 of the two regulatable constant current sources as small as possible, the voltage dropping at them should be relatively small. At the same time, however, it should have a certain minimum value, in order to ensure that the two field effect transistors S2 and S4 are operated in their linear region and thus make possible an effective regulation of the current.

This can be attained in that a d.c. voltage $U_{BUS}$ is delivered to the full bridge circuit which is only slightly higher than the voltage dropping across the gas discharge lamp LA, since the excess of the d.c. voltage $U_{BUS}$ necessarily drops at the two transistors S2 and S4. For this reason the ballast has further a regulation circuit 1 to which the voltage dropping via the field effect transistor S2 or S4 of the respectively active diagonal is delivered as an actual value via the two input lines $\mathbf{10}_1$ or $\mathbf{10}_2$. This actual value is compared with a desired value $I_{FETsoll}$ which corresponds to the value which makes possible a particularly effective current regulation. On the basis of this comparison, the regulation circuit 1 generates a control signal which is employed for the regulation of the d.c. voltage $U_{BUS}$.

Figure 2:
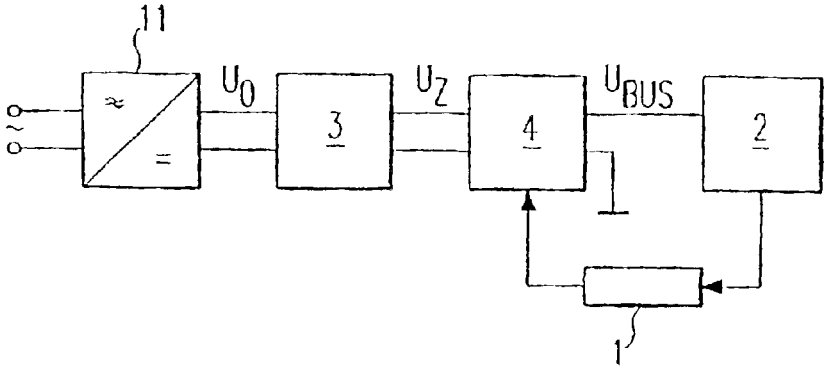
FIG. 2 is a block circuit diagram of a first ballast, with which the full bridge circuit illustrated in FIG. 1 is put to use.

This is illustrated in FIG. 2 which shows the block circuit diagram of a ballast. The input of the ballast is formed by a rectifier circuit 11, for example a full bridge rectifier, connected with an a.c. voltage source, which rectifier delivers to a first switching regulator 3 a rectified a.c. voltage $U_1$. This first switching regulator 3 is formed by means of an up-converter which generates a high intermediate circuit voltage $U_Z$, which is delivered to a second switching regulator 4. This second switching regulator 4 is a down-converter, which steps down the high intermediate circuit voltage $U_Z$ to the necessary lower value for the d.c. voltage $U_{BUS}$. The full bridge circuit illustrated in FIG. 1 is designated by the reference sign 2.

As illustrated in FIG. 2, the regulator circuit 1 controls the down-converter 4 and does this in such a manner that this generates a d.c. voltage $U_{BUS}$ which as intended lies only slightly above the lamp voltage LA so that the voltage dropping across the two transistors S2 and S4 corresponds to the desired value $U_{FETsoll}$. Alternatively to this there would also be the possibility of measuring the voltage drop across the gas discharge lamp LA and on the basis of this value generating a regulation signal for the control of the down-converter.

Figure 3:
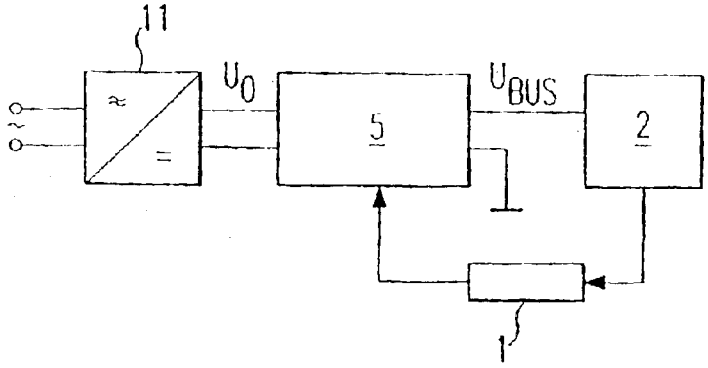
FIG. 3 is a block circuit diagram of a second ballast, with which the full bridge circuit illustrated in FIG. 1 is put to use.

A further possibility is illustrated in FIG. 3. Here, the smoothing circuit for the generation of the d.c. voltage $U_{BUS}$ is not created by means of two switching regulators connected in series, but by means of a buck-boost converter 5 in which the functions of the switching regulators 3 and 4 illustrated in FIG. 2 are combined in one circuit. This integration is possible since the demands on the speed of regulation of the smoothing circuit are relatively slight and thus the occurrence of harmonics at the input of the ballast due to rapid changes of frequency and/or duty ratio is minimized or at least substantially reduced.

The regulation of the lamp current in accordance with the invention by means of the two regulatable constant current sources has, along with the suppression of flickering appearances, also the consequence that upon the switching on of the lamp LA at low lamp brightness no flash can occur, since value due to the two regulatable constant current sources the current is restricted from the beginning to the desired. Thus, a through ignition of the lamp LA takes place at a current which has the lowest possible value for the initiation of an ignition process. In order to make available the ignition voltage necessary for this, the down-converter 4 or the buck-boost converter is so controlled that it makes available a maximum output voltage which is sufficient for the ignition. A further possibility consists in the employment of an ignition coil. With the electronic ballast in accordance with the invention it is possible to dim the gas discharge lamp to 1/1000 of its maximum brightness and to ignite it, without a flickering appearance or a switch-on flash appearing. Further it is advantageous that the lamp wiring has no influence on the dimming operation. This is because since as before switch over with a low frequency takes place, but the high frequency clocking of switches is avoided, and thus due to this "quasi d.c. current" no influence of the wiring impedances arises. The low frequency polarity reversal frequency, i.e. the change over between the two bridge diagonals, should thereby lie at least somewhat above the frequency which is still perceived by the eye, that is at least above 100 Hz. Particularly advantageous is a frequency between 700 Hz and 2000 Hz.

Figure 5:
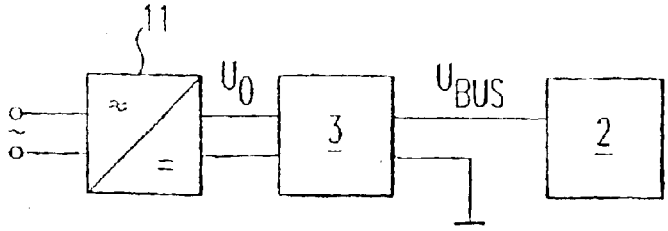
FIG. 5 is a block circuit diagram of an electronic ballast with which the full bridge circuit illustrated in FIG. 4 is put to use.
Figure 4:
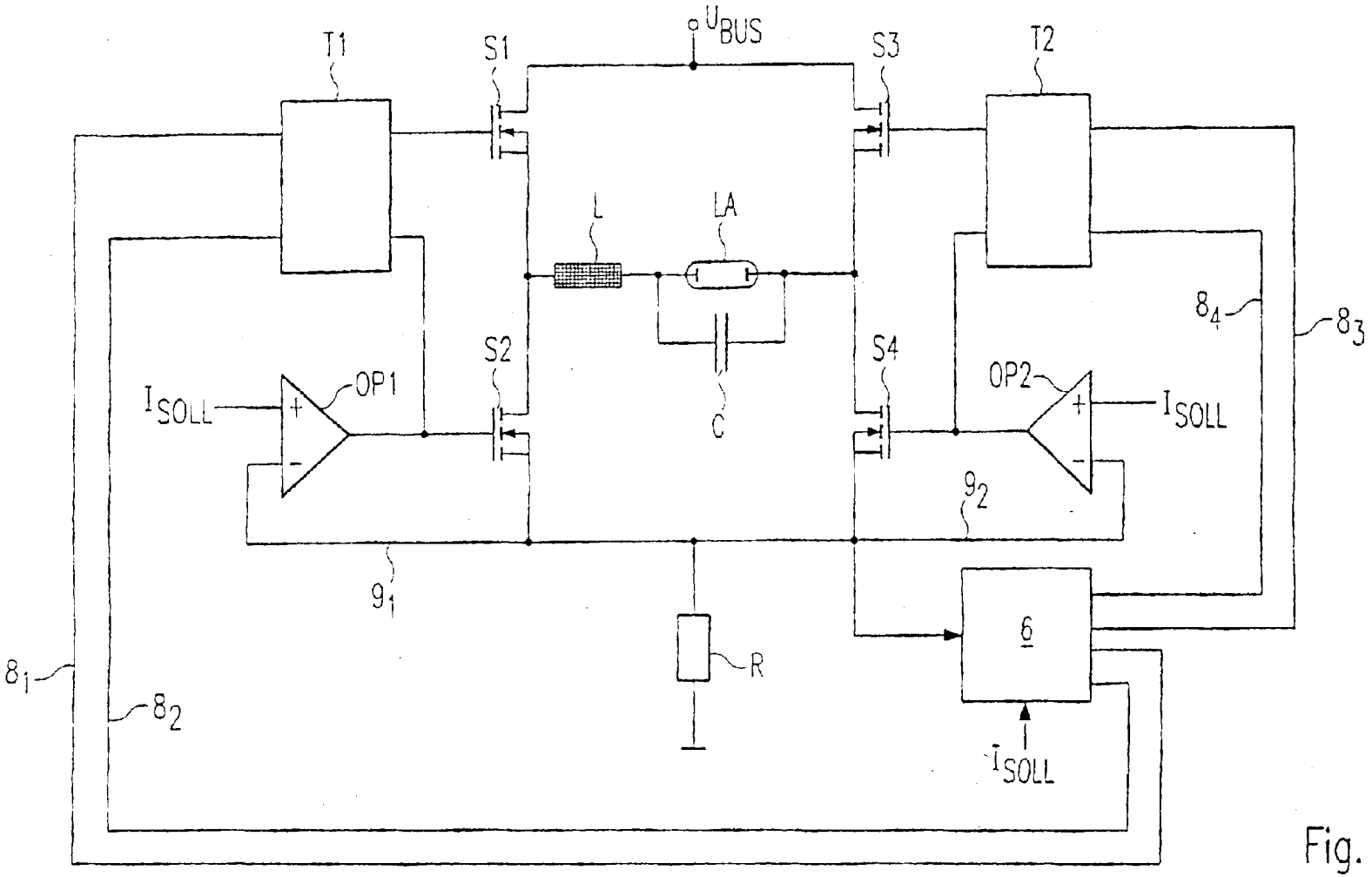
FIG. 4 depicts a second exemplary embodiment of a full bridge circuit in accordance with the invention.

A second exemplary embodiment of the full bridge circuit in accordance with the invention is illustrated in FIG. 4. This differs on the one hand in that the gas discharge lamp LA is now again part of a resonance circuit consisting of an inductance L and a capacitor C, which is connected as a load of the full bridge circuit, and on the other hand in that the regulator 1 described in FIG. 1 for the regulation of the d.c. voltage $U_{BUS}$ is omitted. In this case, there is delivered to the full bridge circuit 2 a d.c. voltage $U_{BUS}$ constant in its level, as is schematically illustrated in FIG. 5. The electronic ballast illustrated in this FIG. 5 now has a rectifier circuit, an up-converter 3 and the full bridge circuit 2.

As also in FIG. 1, with the full bridge circuit illustrated in FIG. 4 there are provided the two regulatable constant current sources consisting of the operational amplifiers OP1 and OP2, and the associated field effect transistors S2 and S4. Due to the d.c. voltage $U_{BUS}$ being constant in its level, there is now however the danger that at high lamp currents, that is, at high brightness, the loss arising through the two transistors S2 and S4 could rise to an unacceptable level.

In order to avoid this, with the exemplary embodiment illustrated in FIG. 4 there is thus a distinction made between two different operational modes, dependent upon the light brightness to be attained, whereby in the range of the low lamp brightness the control of the lamp LA is effected in the same manner as in FIG. 1, i.e. during the switch-on time of one of the two bridge diagonals there is delivered to the lamp a d.c. current regulated by the corresponding regulatable constant current source. Due to the low currents at these brightness values, the losses appearing in the two transistors S2 and S4 play only a subordinate role, so that the omission of the regulation of the d.c. voltage $U_{BUS}$ can be accepted.

With a lamp operation at high brightness, however, the functioning of the two regulatable constant current sources is suppressed and the four transistors S1 to S4 are controlled as also with the known method illustrated in FIG. 6. That is, a change-over between the two bridge diagonals takes place with a relatively low frequency, whereby during the switch-on time of one of the bridge diagonals one of the two transistors is clocked with high frequency, so that the lamp is operated with a d.c. current onto which a high frequency ripple current is superposed. In order to attain a control of brightness in this kind of operation there is necessary a control with variable duty ratio, the inductance L forms in this kind of operation the current limiting impedance in series to the lamp. In this second operational mode the control circuit 6 is again responsible for the control of the lamp brightness and sends via the lines $\mathbf{8}_1$ to $\mathbf{8}_4$ the corresponding control commands to the driver circuits T1 and T2 which correspondingly control the four transistors S1 to S4.

With the high brightness values of the second operational mode, the line capacitances and line inductances, despite the high switching frequency, play no role, because they are negligible relative to the lamp current and thus do not disrupt the regulation processes. Also the risk of the occurrence of flicker appearances does not arise at these high brightnesses. At low brightness values there again arises the ideal ignition behavior, due to the current regulation, with which the appearance of light flashes can be suppressed. Again, a dimming of up to 1/1000 of the maximum lamp brightness is possible.

The concept in accordance with the invention distinguishes itself in that a lamp operation is realized with which a dimming is made possible over a very wide brightness range. Beyond this, the possibility is provided to start the lamp even at very low brightness values without lamp flashes, which are perceived as unpleasant, arising.

While the invention has been particularly shown and described with respect to preferred embodiments thereof, it will be understood by those skilled in the art that changes in form and details may be made therein without departing from the scope and spirit of the invention.

What is claimed is:

1. An electronic ballast for controlling an operating behavior and brightness of a gas discharge lamp, the electronic ballast comprising a full bridge circuit fed with a d.c. voltage, the gas discharge lamp being connected as a load of the full bridge circuit, and a control circuit in each case switching on one bridge diagonal of the full bridge circuit and switching off another bridge diagonal of the full bridge circuit, alternatingly, wherein the bridge diagonals each have a regulatable constant current source for regulating a current of the gas discharge lamp.

2. The electronic ballast according to claim 1, wherein a change-over between the bridge diagonals carried out by the control circuit is effected with a frequency of more than 100 Hz.

3. The electronic ballast according to claim 2, wherein the change-over between two bridge diagonals carried out by the control circuit is effected with a frequency between 700 Hz and 2000 Hz.

4. The electronic ballast according to any one of claims 1 to 3, wherein in a case in which the gas discharge lamp is operating at a low brightness, only a single one of the bridge diagonals is switched on.

5. The electronic ballast according to any one of claims 1 to 3, further comprising a controllable smoothing circuit, fed with a rectified a.c. voltage, for generating the d.c. voltage fed to the full bridge circuit, and a regulation circuit for detecting a voltage drop via the regulatable constant current source of a respective switched-on bridge diagonal, and controlling the smoothing circuit such that the voltage drop via the regulatable constant current source in substance corresponds to a predetermined desired value.

6. The electronic ballast according to claim 5, wherein the smoothing circuit is formed by means of a first switching regulator, fed with the rectified a.c. voltage, for generation of an intermediate circuit voltage, and a second switching regulator, connected in series with the first switching regulator and controlled by the regulation circuit.

7. The electronic ballast according to claim 6, wherein the first switching regulator is an up-converter.

8. The electronic ballast according to claim 6, wherein the second switching regulator is down-converter.

9. The electronic ballast according to claim 5, wherein the smoothing circuit is constituted by means of a buck-boost converter.

10. The electronic ballast according to any one of claims 1 to 3, wherein the gas discharge lamp is a component of a resonance circuit connected as a load of the full bridge circuit, and wherein in a first operational mode of the gas discharge lamp at a low lamp brightness, regulation of a lamp current is effected by means of the regulatable constant current source of a switched-on one of the bridge diagonals, and wherein in a second operational mode of the gas discharge lamp at a high lamp brightness there is delivered to the resonance circuit an a.c. voltage having a constant frequency but having a variable duty ratio.

11. A method for controlling a brightness of a gas discharge lamp which is connected as a load of a full bridge circuit, the method comprising the steps of:

in each case switching on one bridge diagonal of the full bridge circuit and switching off another bridge diagonal of the full bridge circuit, alternatingly; and during a switch-on time of one bridge diagonal, regulating a current through the gas discharge lamp with an adjustable constant current source.

12. The method according to claim 11, further comprising supplying a regulatable d.c. voltage to the full bridge circuit, which d.c. voltage lies around a predetermined value above a lamp voltage.

13. The method according to claim 11 or 12, wherein only at a low lamp brightness in a first operational mode is the current through the gas discharge lamp, during the switch-on time of one bridge diagonal, regulated by the adjustable constant current source, and at a high lamp brightness in a second operational mode, the gas discharge lamp is operated with a voltage having a high frequency a.c. voltage component.

14. The method according to claim 13, further comprising varying a duty ratio of the high frequency a.c. voltage component, for a brightness regulation of the gas discharge lamp.

15. The method according to claim 11 or 12, wherein a change-over between the bridge diagonals is effected with a frequency of more than 100 Hz.

16. The method according to claim 15, wherein the change-over between the bridge diagonals is effected with a frequency between 700 Hz and 2000 Hz.

17. The method according to claim 11 or 12, wherein with a lamp operation at a low brightness, only a single bridge diagonal is switched on.

18. A method for controlling a brightness of a gas discharge lamp which is a component of a resonance circuit connected as a load of a full bridge circuit, the method comprising, in each case, switching on one bridge diagonal of the full bridge circuit and switching off another bridge diagonal of the full bridge circuit, alternatingly, regulating a current through the gas discharge lamp with an adjustable constant current source, at a low lamp brightness in a first operational mode and during a switch-on time of one bridge diagonal, and, at a high lamp brightness in a second operational mode, operating the gas discharge lamp with a voltage having a high frequency a.c. voltage component.

19. The method according to claim 18, further comprising varying a duty ratio of the high frequency a.c. voltage component, for regulating the brightness of the gas discharge lamp.

* * * * *